United States Patent [19]

Sullivan

[11] Patent Number: 4,522,308

[45] Date of Patent: Jun. 11, 1985

[54] MANUALLY MOUNTABLE TAMPER EVIDENT ORAL LIQUID DOSE VIRAL AND SEAL ASSEMBLY

[76] Inventor: James J. Sullivan, 1329 N. Foothill Rd., Ojai, Calif. 93023

[21] Appl. No.: 572,154

[22] Filed: Jan. 18, 1984

[51] Int. Cl.[3] ..... B65D 41/62

[52] U.S. Cl. ..... 215/253; 215/254; 215/256

[58] Field of Search ..... 215/253, 250, 251, 254, 215/255, 256

[56] References Cited

U.S. PATENT DOCUMENTS

| | | | |
|---|---|---|---|
| 3,899,097 | 8/1975 | Aichinger | 215/253 |
| 3,974,931 | 8/1976 | Moller | 215/254 |
| 4,276,988 | 7/1981 | Kimm et al. | 215/253 X |
| 4,322,010 | 3/1982 | Curry | 215/256 |
| 4,354,610 | 10/1982 | Kessler et al. | 215/253 |
| 4,434,904 | 3/1984 | D'Amico et al. | 215/253 X |

*Primary Examiner*—Steven M. Pollard

*Attorney, Agent, or Firm*—Klein & Szekeres

[57] ABSTRACT

An oral liquid dose vial and seal combination is disclosed which requires no crimping or other tools for assembly. A graduated vial of the combination has a circumferential external lip substantially adjacent to its mouth. A unitary plastic seal for the vial has a base plate and an endless rib protruding from the base plate. The rib is configured to fit into the mouth of the vial and to sealingly engage interior walls of the vial. A lip rims the circumference of the base plate and includes inwardly protruding ribs which engage the lip of the vial. A grippable tab is attached to the lip of the seal. Portions of the lip of the vial have thin walls so as to be frangible and to break when the tab is pulled upwardly with a force exceeding a predetermined threshold level. When the frangible portions of the lip of the vial break, the lip partially separates from the base plate, and the entire seal is pulled off the vial by the upwardly directed force.

5 Claims, 6 Drawing Figures

MANUALLY MOUNTABLE TAMPER EVIDENT ORAL LIQUID DOSE VIRAL AND SEAL ASSEMBLY

BACKGROUND OF THE INVENTION

1. Field of the Invention

The present invention is directed to a vial and seal assembly. More particularly, the present invention is directed to an oral liquid dose vial and seal assembly of the type commonly used for dispensing a single dose of liquid or powdery medication.

2. Brief Description of the Prior Art

Oral liquid dose or "unit of use" vials are commonly used mainly in hospitals, for dispensing liquid and occasionally powdery medication to patients.

More specifically, liquid (and occasionally powdery) medications are often ordered for patients in doses of approximately 5 to 50 mililiters. Pharmacies, mainly pharmacies of hospitals, commonly dispense such doses of liquid (or powdery) medications by transferring a single dose of the medication from a large container into a sealable vial or small bottle. After sealing, the vial or small bottle is delivered to the patient. Prior to taking the medication, the patient or an attendant breaks the seal. Thereafter the entire contents of the "unit-of-use" vial are orally taken by the patient. The broken seal, and usually the vial as well, is discarded after such one-time use.

During the recent years it has also become important to seal and safeguard the above-described oral dose medications in a tamper evident manner. For this reason, the prior art has provided seals which include a rubber (or like material) lined aluminum cap. A tab is attached to the cap. In order to break the seal, a user pulls on the tab to destroy the aluminum cap. Some lined aluminum caps of the prior art have a metal insert wherein a conspicuous puncture mark is left if, while tampering with the contents of the vial, a needle is inserted through the seal into the vial. The above-noted prior art oral liquid dose vials and seals are manufactured, for example, by Wheaton Scientific Corporation of Millville N.J.

A significant disadvantage of the above-noted prior art liquid dose vial and seal assemblies is that the lined metal cap must be affixed to the vial by appropriately crimping the cap to the vial. The crimping operation is often performed separately for each individual vial through the use of a crimping tool, or with a crimping machine into which the individual vials are usually manually fed. As it will be readily appreciated by those skilled in the art, the crimping operation is undesirable in a pharmacy because it is time consuming and therefore expensive. The wasteful nature of the crimping operation is particularly appreciated in view of the fact that the oral liquid dose vials are usually filled with medication and are used and discarded within a short period of time, usually a day or less.

An additional disadvantage of the oral liquid dose vial and seal assemblies of the prior art is that they often leak. As it will be again readily appreciated by those skilled in the art, accidental leakage of medication from the vials is highly undesirable, particularly in a hospital environment.

For the above-noted and other reasons, a definite need exists in the prior art for an oral liquid dose vial and seal combination which is inexpensive to manufacture, requires no tools for assembly or sealing, is substantially leak-proof and tamper evident. The present invention provides such a vial and seal combination.

SUMMARY OF THE INVENTION

It is an object of the present invention to provide an oral liquid dose vial and seal combination which is tamper evident.

It is another object of the present invention to provide an oral liquid dose vial and seal combination which is substantially leak proof.

It is still another object of the present invention to provide an oral liquid dose vial and seal combination which is readily assembled in a single simple manual operation, without requiring the use of tools.

It is yet another object of the present invention to provide an oral liquid dose vial and seal combination where the volume of contents of the vial is visually indicated.

These and other objects and advantages are attained by a vial and seal combination or assembly which includes a vial of approximately 5 to 100 mililiters volume, having an outwardly projecting circumferential lip substantially adjacent to the opening of the vial.

A unitary plastic seal, mountable on the vial, includes a base plate configured to cover the mouth of the vial. An inwardly projecting endless rib protrudes from the base plate towards the interior of the vial, and sealingly engages interior walls of the vial. A downwardly protruding lip rims the circumference of the base plate of the seal. The lip of the seal has a plurality of inwardly projecting ribs. The inwardly projecting ribs engage the lip of the vial.

A tab, grippable by an operator is attached to the lip of the seal. The lip of the seal also includes frangible, thin walled sections configured and disposed to break when the tab is pulled upwardly by a force exceeding a predetermined threshold level. Upward pulling of the tab thus destroys the seal, and removes it from the vial.

The vial is preferably graduated so as to alert the pharmacist filling the vial, to the importance of accurately dispensing a prescribed volume of medication into the vial, and to generally prevent over or under medication of patients.

The features of the present invention can be best understood together with further objects and advantages by reference to the following description, taken in connection with the accompanying drawings, wherein like numerals indicate like parts.

DESCRIPTION OF THE PREFERRED EMBODIMENT

Figure 1:
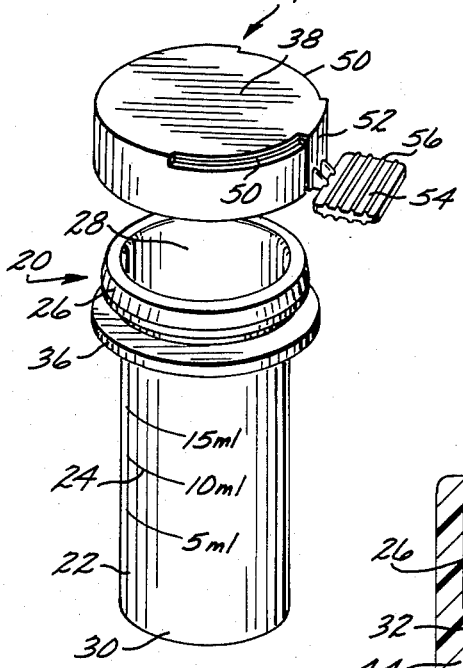
FIG. 1 is an exploded perspective view of a preferred embodiment of the oral liquid dose vial and seal assembly of the present invention.
Figure 2:
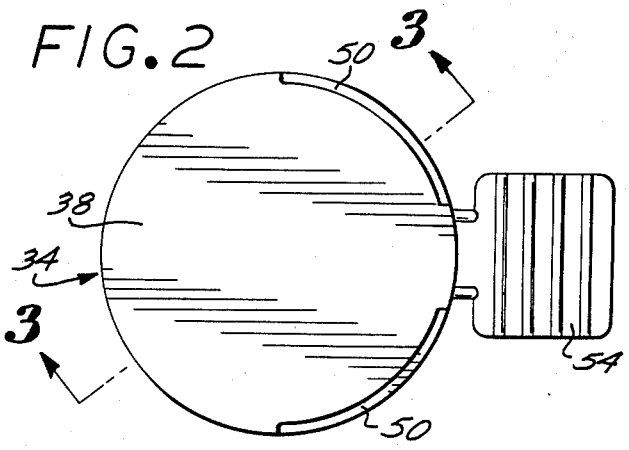
FIG. 2 is a top view of the vial and seal assembly shown on FIG. 1.

The following specification taken in conjunction with the drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Referring now to the drawing Figures, a preferred embodiment of the vial and seal combination or assembly 20 of the present invention is disclosed. The vial and seal assembly of the present invention is designed as a "unit-of-use" or "oral liquid dose" vial and seal combination, primarily for use in the environment which is described in the introductory section of the present application for patent. Briefly, the vial and seal assembly 20 of the present invention is most advantageously used in hospitals, where a prescribed dose of oral liquid medication is dispensed into the vial, the vial is quickly sealed and delivered to a patient for ingestion of the entire content of the vial in a single dose.

The vial and seal assembly of the present invention is well suited for use in the above-noted environment, because it permits rapid placement of the seal on the vial in a single manual operation. Moreover, the seal is tamper evident, as it is destroyed even by a single removal. Still further, if a hypodermic needle were inserted into the seal in an effort to tamper with the contents of the vial a readily visible puncture mark would be left on the seal. This is apparent from an inspection of the drawing Figures depicting the vial and seal combinations.

As is shown on the exploded perspective view of FIG. 1, the combination 20 of the present invention includes a vial 22. The vial 22 is preferably made of plastic, such as medical grade poly propylene, although vials made of other materials, such as glass, may also be used in accordance with the present invention. The vial 22 has an internal volume of the magnitude which is commonly used in conjunction with oral liquid dose or unit-of-use liquid medication. Thus, the volume of the vial 22 is typically in the 5 to 100 ml range, with the 5 to 50 ml range being preferred. Because in actual hospital practice, oral liquid dose vials of approximately 5 to 30 ml volume are used most frequently, the perspective view of FIG. 1 illustrates a fifteen (15) ml vial 22.

Preferably, as is shown on FIG. 1, the vial 22 is graduated to clearly indicate certain volume levels thereon. The graduation 24 alerts the pharmacist (not shown) who fills the vial 22, to the importance of accurately dispensing the medication (not shown) into the vial 22. The graduation 24 also serves as a safeguard against accidental overdosage and underdosage.

Figure 3:
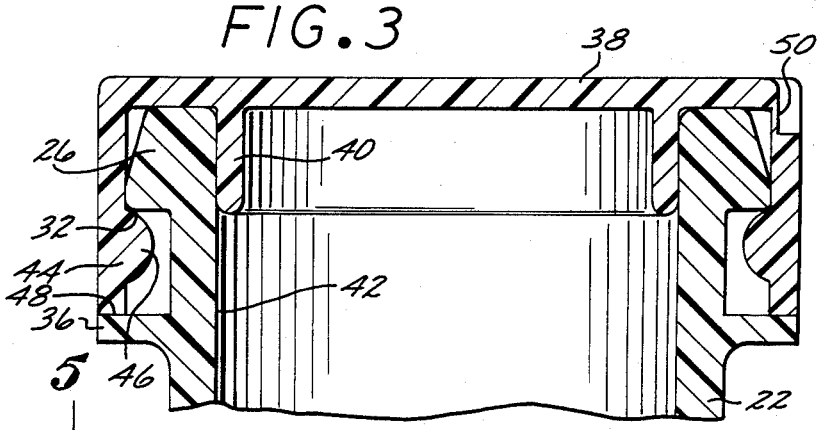
FIG. 3 is a cross-sectional view of the preferred embodiment of the vial and seal assembly, the cross-section being taken on lines 3,3 of FIG. 2.
Figure 4:
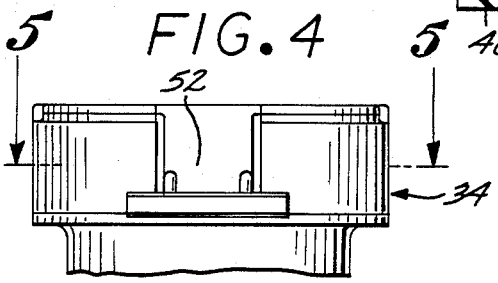
FIG. 4 is a partial front view of the preferred embodiment of the vial and seal assembly.
Figure 5:
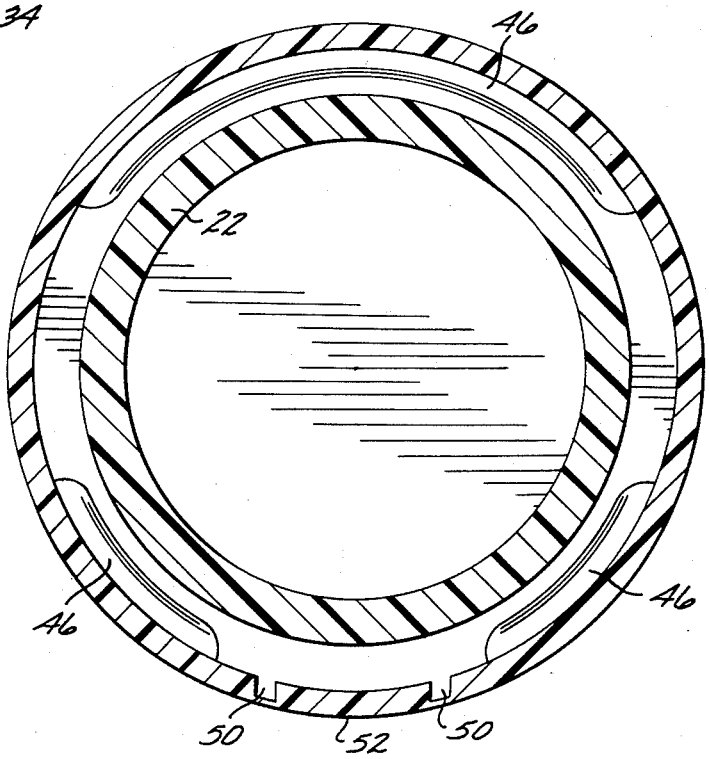
FIG. 5 is a cross-sectional view of the preferred embodiment, the cross-section being taken on lines 5,5 of FIG. 4.
Figure 6:
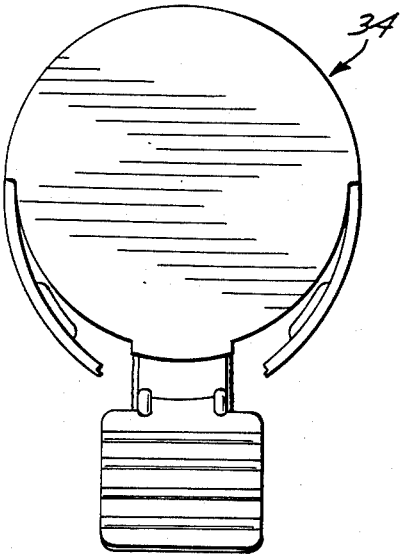
FIG. 6 is a top view of the seal of the preferred embodiment of the present invention, after frangible portions of the seal had been broken.

The vial 22 includes peripheral, circumferential lip 26 which is disposed substantially adjacent to the opening or mouth 28 of the vial 22. Preferably, the circumferential lip 26 is tapered, as is best shown on the cross-sectional view of FIG. 3, so as to provide a relatively gradual camming surface leading away from the mouth 28 of the vial 22. However, on a side facing towards the bottom 30 of the vial 22, the lip 26 preferably has a relatively sharp edge 32, as is best shown on FIG. 3. The sharp edge 32 serves to engage a complementary rib of a seal 34 for the vial 22, as is described below.

The vial 22 also includes on its outer periphery a second circumferential lip 36. The second lip 36 is disposed below the first lip 26 in spaced, parallel relationship ship therewith. The second lip 36 of the vial 22 may support the vial 22 in a rack (not shown) which is customarily used in hospitals to hold, manipulate and transport a plurality of oral liquid dose vials. The second lip 36 also serves for engaging a rib of the seal 34, as is described below in conjunction with detailed description of the seal 34. The entire vial 22 is readily manufactured from its plastic material by an injection molding or blow molding process.

The seal 34, shown on FIGS. 1–6, is of unitary construction, and comprises medical grade plastic, such as medical grade low density poly ethylene. Preferably, the seal 34 is made by injection molding or blow molding low density poly ethylene into the hereinafter described configuration.

Thus, the seal 34 includes a base plate 38 which is configured to cover the opening or mouth 28 of the vial 22. A rib 40 projects downwardly from the base plate 38 towards the interior of the vial 22. The rib 40 is dimensioned to tightly fit within the mouth 28 of the vial 22. In other words, the rib 40 is in intimate contact with interior walls 42 of the vial 22, when the seal 34 is placed on the vial 22. The foregoing is best shown on the cross-sectional view of FIG. 3.

Regarding the shape of the vial 22 and the rib 40 of the seal 34, the vial 22 is noted to be of a cylindrical overall configuration in the herein described preferred embodiment. Therefore, the rib 40 of the seal 34 is a ring concentric with the substantially disc shaped base plate 38 of the seal 34. Diameter of the ring shaped rib 40 is smaller than the diameter of the base plate 38.

The seal 34 further includes a lip 44 which rims the circumference of the base plate 38, and projects downwardly from the base plate 38 towards the bottom 30 of the vial 22. The lip 44 of the seal 34 includes three (3) inwardly projecting ribs 46. The inwardly projecting ribs 46 of the seal 34 are configured to tightly engage the first lip 26 of the vial 22, as is best shown on FIG. 3. The inwardly projecting ribs 46 securely hold the seal 34 on the vial 22 until the seal 34 is deliberately removed from the vial 22.

A lower edge 48 of the lip 44 of the seal 34 preferably engages and rests on the second lip 36 of the vial 22.

It is an important novel feature of the present invention that a portion of the seal 34 is frangible to enable a user (not shown) to remove the seal 34 from the vial 22, while simultaneously destroying the seal 34. To this end, the material of two arc shaped portions 50 of the seal 34 which connect the lip 44 to the base plate 38 is deliberately molded to be thin and weak. This is best shown on FIGS. 1, 2 and 3.

The thin, weak walled portions or strips within the seal 34 continue from the arc, downwardly into the lip 44 so as to define a segment 52 of the lip 44 of the seal 34 bounded by said thin walled, frangible strips 50. A tab 54, having parallel spaced ribs or protrusions 56, projects outwardly from the segment 52 of the lip 44 of the seal 34. The protrusions 56 of the tab 54 facilitate gripping of the tab 54 by a patient (not shown) or nurse (not shown) when the vial and seal assembly 20 of the present invention is about to be opened.

As a further important novel feature of the present invention, one of the inwardly projecting ribs 46 of the seal 34 is disposed substantially adjacent to the frangible wall bounded segment 52 of the seal 34 on each side of the segment 52. A third one of the inwardly projecting ribs 46 is disposed substantially opposite to the segment 52. The third inwardly projecting rib 46 covers a substantially larger portion of the circumference of the vial 22 than any one of the two ribs 46 which are adjacent to the segment 52. Each of the latter extend approximately $\frac{1}{8}$ to $\frac{1}{3}$ around the circumference of the vial 22.

It should be readily apparent from the foregoing description that the seal 34 of the present invention is readily placed upon the vial 22 in a single manual operation, without the need for using any kind of machine or crimping device.

The seal 34 is substantially leak proof on the vial 22 because there are several barriers to outflow of liquid (not shown) from the vial 22. The first and most important barrier is the rib 40 of the seal 40. Another barrier is the lower edge 48 of the lip 44 of the seal 34 which engages the second lip 36 of the vial 22.

In order to break the seal 34 and to remove it from the vial 22, a user (not shown) pulls the tab 54 in an upwardly direction with a force which exceeds the predetermined breaking strength of the frangible portions 50 of the seal 34. The frangible portions 50 break, partially separating the lip 44 of the seal 34 from the base plate 38, and disengaging two inwardly facing ribs 46 of the seal 34 from the first lip 26 of the vial 22.

Finally, the user's upward pulling motion on the tab 54 removes the first rib 40 of the seal 34 from the mouth 20 of the vial 22. On FIG. 6 a seal 34 of the present invention is shown in the "broken" condition, after it was removed from the vial 22 in the above-described manner.

Several modifications of the vial and seal assembly of the present invention may become readily apparent to those skilled in the art in light of the above disclosure. Therefore, the scope of the present invention should be interpreted solely from the herein appended claims.

What is claimed is:

1. A tamper evident and substantially leak-proof oral liquid dose vial and seal assembly having a substantially cylindrical vial of approximately 5 to 100 mililiters in volume, and a seal adapted for one-time sealing of the vial and to be substantially destroyed when removed from said vial, the assembly comprising:

a first lip disposed on the circular outer circumference of the vial substantially adjacent to the mouth of the vial;

a base plate of the seal disposed on the top of the vial to cover the mouth;

a substantially circular sealing rib disposed at substantially right angle to the base plate and projecting inwardly into the interior of the vial in sealing engagement with interior walls of the vial;

a lip of the seal attached to the base plate of the seal and projecting downwardly from the base plate around the circumference of the base plate;

a plurality of ribs projecting inwardly from the lip of the seal below the rib of the vial and in engagement therewith;

a first frangible portion of the seal comprising a first narrow continuous strip of thin walled material which extends approximately one eighth to one third around the circumference of the base plate between the base plate and the lip of the seal, and which further extends into the lip of the seal from the base plate to the lower end of said lip;

a second frangible portion of the seal comprising a second narrow continuous strip of thin walled material which extends approximately one eighth to one third around the circumference of the base plate between the base plate and the lip of the seal, and which further extends into the lip of the seal from the base plate to the lower end of said lip, a portion of the lip of the seal being disposed between the first and second frangible portions of the seal, and a tab, adapted to be gripped and pulled by an operator, attached to the portion of the lip of the seal which is disposed between the first and second frangible portions whereby upward pulling of the tab breaks the frangible portions, disengages at least one rib of the lip of the seal from the lip of the vial and removes the seal from the vial.

2. The vial and seal assembly of claim 1, wherein the vial further comprises a second circumferential circular lip disposed on the outer periphery of the vial below the first lip of the vial and spaced relative thereto to engage the end of the lip of the seal.

3. The vial and seal assembly of claim 1 wherein at least three ribs project inwardly from the lip of the seal below the rib of the vial to engage the rib of the vial.

4. The vial and seal assembly of claim 3 wherein one inwardly projecting rib of the lip of the seal is disposed below each strip of thin walled material which is disposed on the circumference of the base plate.

5. The vial and seal assembly of claim 4 wherein the vial comprises poly propylene and the seal comprises low density poly ethylene.

* * * * *